US008240819B2

(12) United States Patent
Seki

(10) Patent No.: US 8,240,819 B2
(45) Date of Patent: Aug. 14, 2012

(54) INK JET HEAD WITH LASER-MACHINED NOZZLES AND METHOD OF MANUFACTURING INK JET HEAD

(75) Inventor: Masashi Seki, Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 290 days.

(21) Appl. No.: 12/726,032

(22) Filed: Mar. 17, 2010

(65) Prior Publication Data

US 2010/0238237 A1 Sep. 23, 2010

(30) Foreign Application Priority Data

Mar. 18, 2009 (JP) ..... 2009-066774

(51) Int. Cl.
*B41J 2/045* (2006.01)

(52) U.S. Cl. ..... 347/71; 347/68; 347/69; 347/72

(58) Field of Classification Search ..... 347/71, 347/72, 68, 69, 70; 29/25.35
See application file for complete search history.

(56) References Cited

FOREIGN PATENT DOCUMENTS

JP 2002-160364 A 6/2002
JP 2003266691 A 9/2003

OTHER PUBLICATIONS

Official Letter dated Feb. 8, 2011, from Japan Patent Office for corresponding Japan Patent Application No. 2009-066774.
U.S. Appl. No. 12/689,199, Seki.

*Primary Examiner* — Matthew Luu
*Assistant Examiner* — Henok Legesse
(74) *Attorney, Agent, or Firm* — Patterson & Sheridan, LLP

(57) ABSTRACT

An ink jet head includes a piezoelectric element including pressure chambers and partition walls, a nozzle plate including nozzles which are laser-machined, an adhesive which adheres the nozzle plate to the partition walls, a first protection film covering an electrode, and a second protection film which is stacked on the first protection film. The adhesive includes an excess portion which protrudes into the pressure chamber. A cut portion along a direction of radiation of a laser beam is formed at the excess portion. The second protection film includes a damage hole at an area on which the laser beam is made incident. The first protection film is exposed from the damage hole. A part of the first protection film, which corresponds to the damage hole, has a film thickness of 0.1 μm to 0.5 μm, and the first protection film has a refractive index of 1.1 to 2.0.

11 Claims, 8 Drawing Sheets

INK JET HEAD WITH LASER-MACHINED NOZZLES AND METHOD OF MANUFACTURING INK JET HEAD

CROSS-REFERENCE TO RELATED APPLICATION

This application is based upon and claims the benefit of priority from prior Japanese Patent Application No. 2009-066774, filed Mar. 18, 2009, the entire contents of which are incorporated herein by reference.

TECHNICAL FILED

This disclosure relates to an ink jet head including an electrode which is covered with a protection layer, and laser-machined nozzles.

BACKGROUND

Jpn. Pat. Appln. KOKAI Publication No. 2002-160364 discloses a so-called shear-mode-type ink jet head which discharges ink from a plurality of nozzles. This type of ink jet head includes a piezoelectric ceramics plate, an ink chamber plate which is adhered to the surface of the piezoelectric ceramics plate, and a nozzle plate which is adhered in a manner to span between the end face of the piezoelectric ceramics plate and the end face of the ink chamber plate.

The piezoelectric ceramics plate includes a plurality of grooves and a plurality of partition walls. The grooves are arranged in line at intervals, and are continuously open to the surface and end face of the piezoelectric ceramics plate. The partition walls are interposed between neighboring ones of the grooves and isolate the grooves from one another.

The ink chamber plate closes the grooves of the piezoelectric ceramics plate from the direction of the surface of the piezoelectric ceramics plate. The nozzle plate closes the grooves of the piezoelectric ceramics plate from the direction of the end face of the piezoelectric ceramics plate. The inner surfaces of the grooves, the ink chamber plate and the nozzle plate cooperate and constitute a plurality of pressure chambers into which ink is supplied. Electrodes are formed on the surfaces of the partition walls which face each other, with the pressure chambers being interposed.

A plurality of nozzles are provided in the nozzle plate. The nozzles are obtained by applying laser machining using, for example, an excimer laser device, to the nozzle plate. The nozzles are minute holes on the order of microns, which penetrate the nozzle plate, and are open to the pressure chambers having the electrodes, respectively.

If a driving pulse is applied to the electrode, the partition walls facing each other, with the pressure chamber being interposed, deform and pressurize the ink that is supplied to the pressure chamber. The pressurized ink is discharged from the nozzle of the nozzle plate toward a recording medium on which printing is to be effected.

According to the ink jet head disclosed in the above-described KOKAI publication, a protection layer having electrical insulation properties is laid over each electrode. The protection layer has a two-layer structure comprising an inorganic insulation film and an organic insulation film. As the inorganic insulation film, use is made of an inorganic material such as silicon dioxide ($SiO_2$). The inorganic insulation film covers the electrode and the inner surface of the groove. As the organic insulation film, use is made of an organic material such as polymonochloro-para-xylene. The organic insulation film is laid over the inorganic insulation film and covers the inorganic insulation film.

According to this protection layer, the inorganic insulation film has resistance to an organic solvent, and the organic insulation film has resistance to an inorganic chemical. Thus, even in the case where various kinds of inks having electrical conductivity are used, the electrical insulation between the ink and electrode can be ensured. Therefore, dissolution of the electrode can be prevented, and the discharge characteristic of ink can be improved.

According to the ink jet head disclosed in the above-described KOKAI publication, the protection layer is formed on the electrode after the piezoelectric ceramics plate and ink chamber plate are coupled. Thereafter, the nozzle plate is adhered in a manner to span between the end face of the piezoelectric ceramics plate and the end face of the ink chamber plate.

From the description of the above-described KOKAI publication, however, it cannot be understood whether the nozzle is formed in the nozzle plate before the nozzle plate is adhered to the piezoelectric ceramics plate, or the nozzle is formed in the nozzle plate after the nozzle plate is adhered to the piezoelectric ceramics plate.

In the case where the nozzle plate is adhered to the piezoelectric ceramics plate, it cannot be denied that an excess portion of an adhesive protrudes into the pressure chamber from between the piezoelectric ceramics plate and nozzle plate. At this time, if the nozzle is already formed in the nozzle plate, the excess portion of the adhesive protrudes towards the opening end of the nozzle that opens to the pressure chamber. Consequently, such a state occurs that the opening end of the nozzle is partially closed by the excess portion of the adhesive. If even a part of the opening end of the nozzle is closed, the flow of ink is disturbed when the ink is discharged. As a result, the discharge speed and discharge direction of ink become non-uniform, and the quality of print deteriorates.

On the other hand, in the case where the nozzle is formed in the nozzle plate after the nozzle plate is adhered to the piezoelectric ceramics plate, the adverse effect due to the adhesive can be avoided. Specifically, even if the excess portion of the adhesive protrudes into the pressure chamber, the excess portion of the adhesive is removed by a laser beam when the laser beam for forming the nozzle penetrates the nozzle plate and enters the pressure chamber. Thus, the excess portion of the adhesive does not adversely affect the flow of ink, and the degradation in print quality can be prevented.

The laser beam enters the pressure chamber immediately after penetrating the nozzle plate. In particular, in the case where the nozzle has a taper shape gradually widening toward the pressure chamber, the laser beam, which has penetrated the nozzle plate, is incident on the protection layer at an acute angle to the protection layer in the vicinity of the nozzle.

If the protection layer receives the laser beam, that part of the protection layer, which has been irradiated with the laser beam, is damaged. To be more specific, the laser beam for forming the nozzle in the nozzle plate has a wavelength less than visible light. Thus, if the organic insulation film of the protection layer, which is exposed to the pressure chamber, receives the laser beam, the organic insulation film evaporates and a damage hole opens in the organic insulation film.

As a result, the inorganic insulation film, which is covered with the organic insulation film, is exposed to the pressure chamber through the damage hole. In addition, depending on the thickness and refractive index of the inorganic insulation film, the laser beam may pass through the inorganic insulation film and may reach the electrode or piezoelectric ceramics plate.

If the protection layer is damaged by the laser beam, it is difficult to keep electrical insulation between the ink and electrode. As a result, for example, in the case where ink has electrical conductivity, that part of the electrode, which has received the laser beam, is dissolved, and the durability of the ink jet head lowers.

Furthermore, if the piezoelectric ceramics plate is damaged by the laser beam, the piezoelectric characteristics of the piezoelectric ceramics plate deteriorate. This leads to degradation in print quality of the ink jet head.

SUMMARY

An object of the disclosure is to provide an ink jet head which can enhance the quality of print and can maintain durability.

Another object of the disclosure is to provide a method of manufacturing an ink jet head which can maintain durability while enhancing the quality of print.

In order to achieve the above objects, according to an aspect of the disclosure, there is provided an ink jet head comprising:

a piezoelectric element including a plurality of partition walls arranged at intervals, and a plurality of pressure chambers which are provided between neighboring ones of the partition walls and to which ink is supplied;

a nozzle plate including a plurality of nozzles which discharge the ink, the nozzles being formed by radiating a laser beam on the nozzle plate;

an adhesive which adheres the nozzle plate to the partition walls of the piezoelectric element such that the nozzles communicate with the pressure chambers;

an electrode provided on a surface of the partition wall facing the pressure chamber, the electrode being configured to deform, when supplied with a driving pulse, the partition walls, thereby pressurizing the ink that is supplied to the pressure chamber and discharging the ink from the nozzle;

a first protection film which covers the electrode and is formed of an inorganic material having electrical insulation properties; and a second protection film which is stacked on the first protection film, is exposed to the pressure chamber, and is formed of an organic material having electrical insulation properties.

The adhesive includes an excess portion which protrudes into the pressure chamber from between the nozzle plate and the partition wall, and a cut portion which is provided at the excess portion along a direction of radiation of the laser beam.

The second protection film includes a damage hole at an area on which the laser beam is made incident, the second protection film being removed from the damage hole, and the first protection film is exposed to an inside of the pressure chamber at a position corresponding to the damage hole. At least a part of the first protection film, which corresponds to the damage hole, has a film thickness of 0.1 μm to 0.5 μm, and the first protection film has a refractive index of 1.1 to 2.0.

In order to achieve the above objects, according to another aspect of the disclosure, there is provided a manufacturing method which is applied to an ink jet head comprising:

a piezoelectric element including a plurality of partition walls arranged at intervals, and a plurality of pressure chambers which are provided between neighboring ones of the partition walls and to which ink is supplied;

a nozzle plate including a plurality of nozzles which discharge the ink;

an adhesive which adheres the nozzle plate to the partition walls of the piezoelectric element such that the nozzles communicate with the pressure chambers;

an electrode provided on a surface of the partition wall facing the pressure chamber;

a first protection film which covers the electrode and is formed of an inorganic material having electrical insulation properties; and a second protection film which is stacked on the first protection film, is exposed to the pressure chamber, and is formed of an organic material having electrical insulation properties.

The manufacturing method comprises:

adhering the nozzle plate, in which the nozzles are yet to be formed, to the partition walls by using the adhesive, after covering the electrode with the first protection film;

covering the first protection film with the second protection film by stacking the second protection film on the first protection film; and forming the nozzles by radiating a laser beam on the nozzle plate which is adhered to the partition walls, the laser beam being incident on the second protection film within the pressure chamber after forming the nozzles, at least a part of the first protection film, which corresponds to an area on which the laser beam is incident, having a film thickness of 0.1 μm to 0.5 μm, and the first protection film having a refractive index of 1.1 to 2.0.

According to the disclosure, the durability of an electrode and a piezoelectric element can be enhanced while a good printing quality is maintained, even in an ink jet head in which nozzles are formed by a laser beam and the electrode is covered with a two-layer protection film having electrical insulation properties.

Additional advantages of the disclosure will be set forth in the description which follows, and in part will be obvious from the description, or may be learned by practice of the disclosure. The advantages of the disclosure may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments, and together with the general description given above and the detailed description of the embodiments given below, serve to explain the principles.

DETAILED DESCRIPTION

A first embodiment will now be described with reference to FIG. 1 to FIG. 15.

Figure 1:
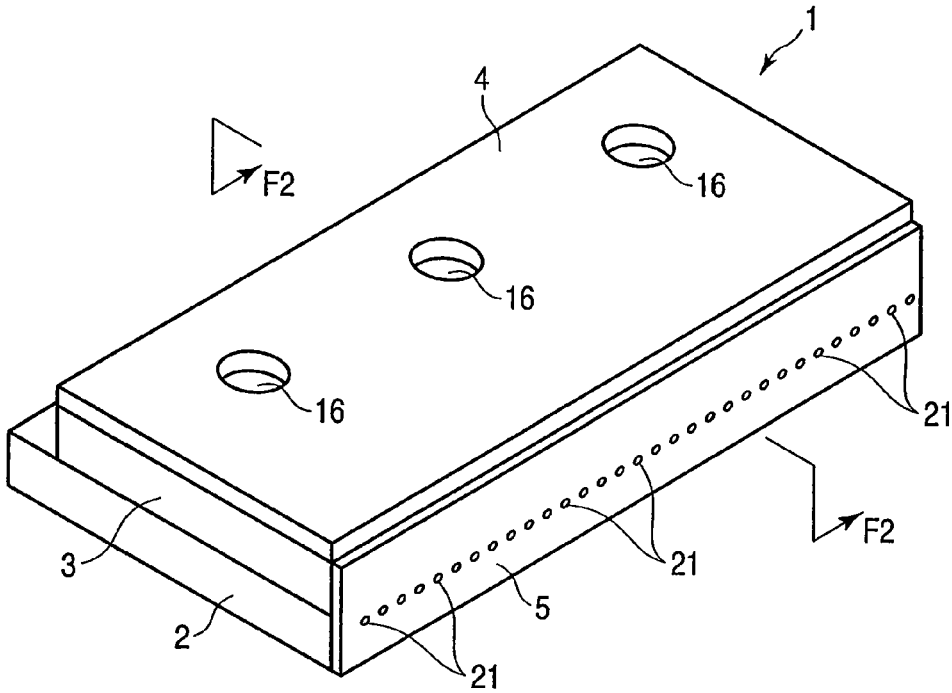
FIG. 1 is a perspective view of an ink jet head according to a first embodiment.
Figure 2:
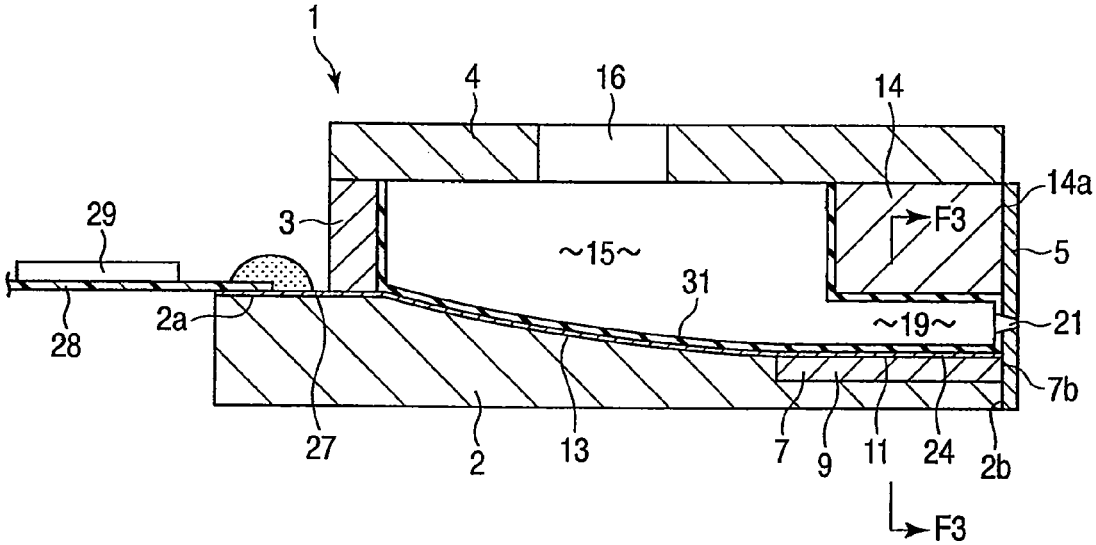
FIG. 2 is a cross-sectional view taken along line F2-F2 line in FIG. 1.

FIG. 1 and FIG. 2 disclose an ink jet head 1 of a shear-mode type which is, when used, attached to a carriage of a printer, for example. The ink jet head 1 comprises a base plate 2, a top plate frame 3, a top plate 4 and a nozzle plate 5.

As the material of the base plate 2, use may be made of, for instance, alumina ($Al_2O_3$), silicon nitride ($Si_3N_4$), silicon carbide (SiC), aluminum nitride (AlN), or lead zirconate titanate (PZT).

Figure 3:
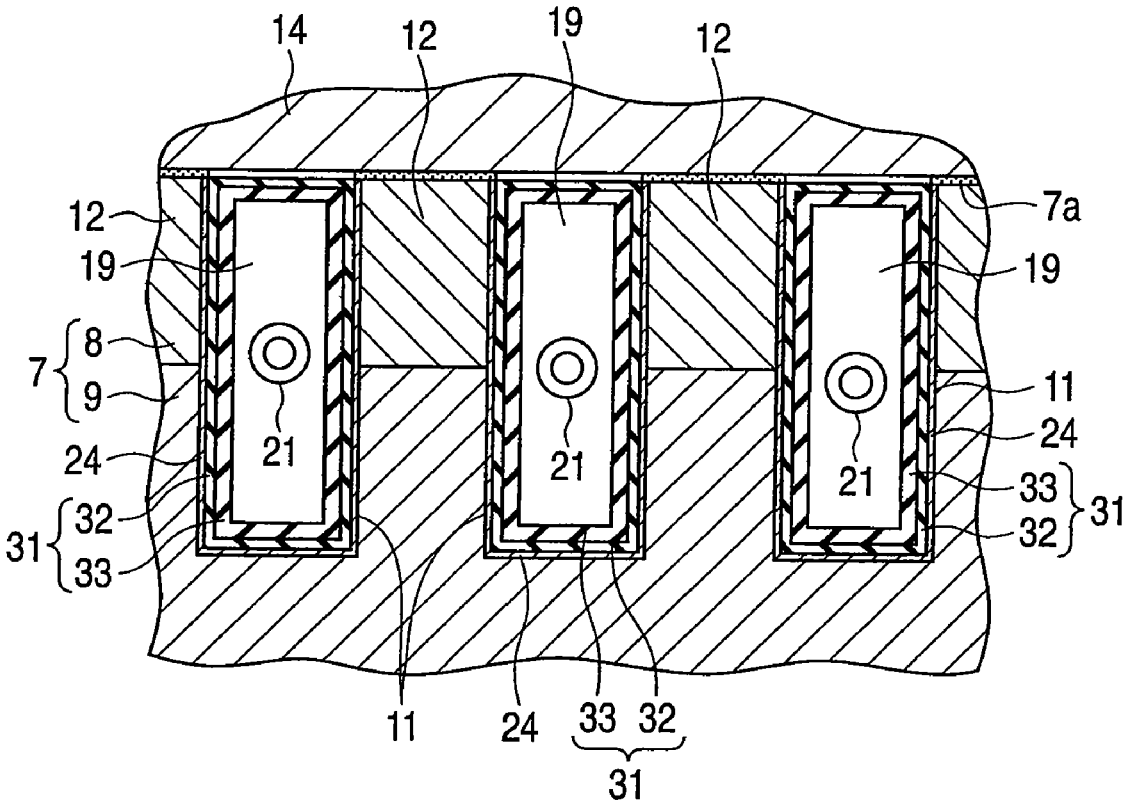
FIG. 3 is a cross-sectional view taken along line F3-F3 in FIG. 2.

As shown in FIG. 2, the base plate 2 has a rectangular shape with a surface 2*a* and an end face 2*b*. A piezoelectric element 7 is embedded in the surface 2*a* of the base plate 2. The piezoelectric element 7 is an example of an actuator. As shown in FIG. 3, the piezoelectric element 7 is configured such that two piezoelectric members 8 and 9 of PZT are stacked and bonded, and the piezoelectric element 7 extends in the longitudinal direction of the base plate 2. The piezoelectric element 7 has a surface 7*a* and an end face 7*b*.

The surface 7*a* of the piezoelectric element 7 is positioned in the same plane as the surface 2*a* of the base plate 2, and is exposed to the outside of the base plate 2. Similarly, the end face 7*b* of the piezoelectric element 7 is positioned in the same plane as the end face 2*b* of the base plate 2, and is exposed to the outside of the base plate 2. The polarization directions of the piezoelectric members 8 and 9 are opposite to each other in the thickness direction of the piezoelectric members 8 and 9. In the present embodiment, in consideration of the difference in expansion coefficient between the base plate 2 and piezoelectric element 7 and the dielectric constants of the base plate 2 and piezoelectric element 7, PZT, which has a lower dielectric constant than the piezoelectric element 7, is used as the material of the base plate 2.

Figure 4:
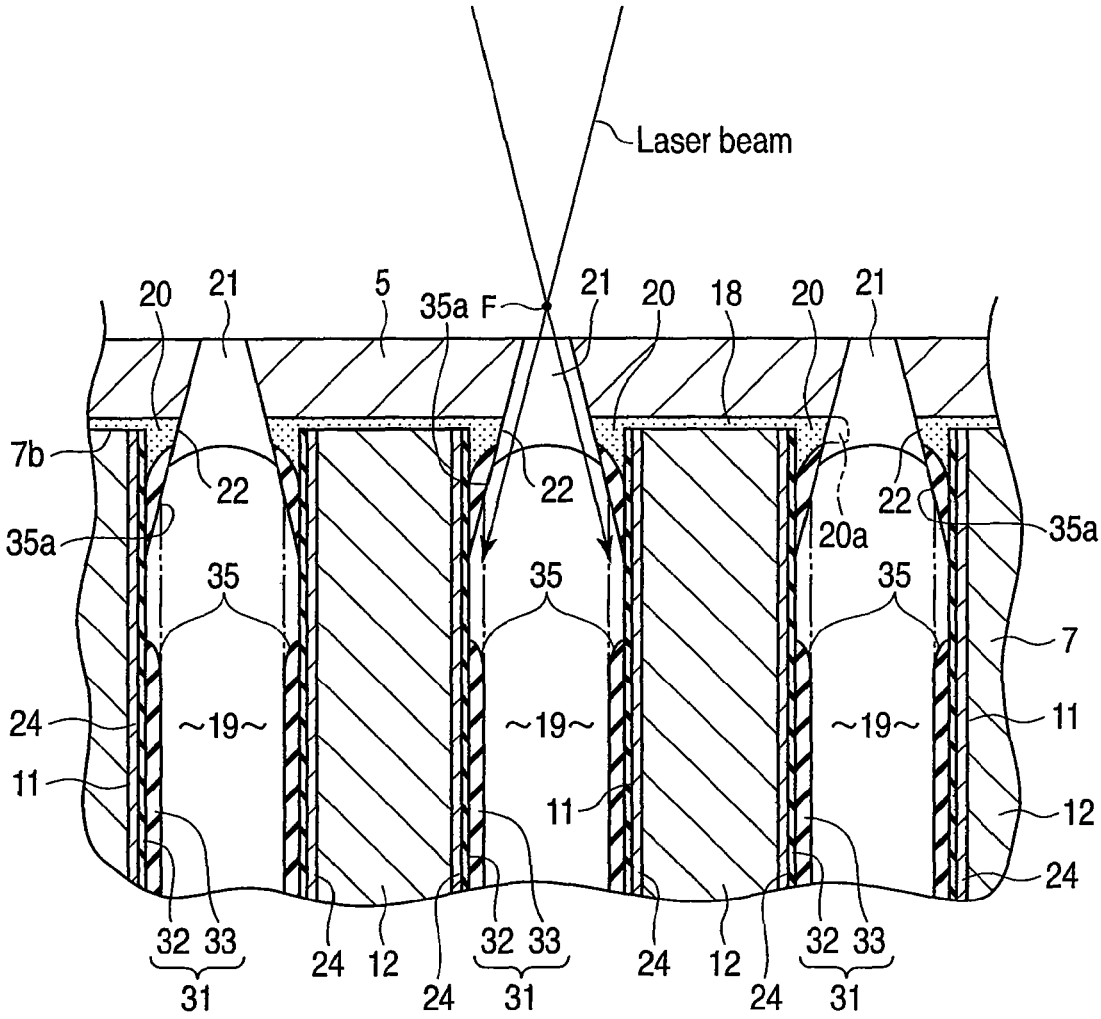
FIG. 4 is a cross-sectional view of the ink jet head according to the first embodiment.

As shown in FIG. 2 to FIG. 4, a plurality of long grooves 11 and a plurality of partition walls 12 are formed in the piezoelectric element 7. The long grooves 11 are open to the surface 7*a* and end face 7*b* of the piezoelectric element 7 and are arranged in line at intervals in the longitudinal direction of the piezoelectric element 7. According to the present embodiment, each long groove 11 has a depth of 300 μm and a width of 80 μm, and the long grooves 11 are arranged in parallel with a pitch of 169 μm. The partition walls 12 are interposed between neighboring ones of the long grooves 11 and isolate the long grooves 11 from one another.

Each long groove 11 has an extension portion 13 which is extended from one end portion thereof in its longitudinal direction toward the base plate 2. The extension portion 13 is open to the surface 2*a* of the base plate 2 and has a depth dimension gradually decreasing in a direction away from the piezoelectric element 7. Thus, the end portion of each long groove 11, which is opposite to the piezoelectric element 7, is continuous with the surface 2*a* of the base plate 2.

The top plate frame 3 is fixed to the surface 2*a* of the base plate 2 by means of, e.g. adhesion. The top plate frame 3 includes a front frame portion 14. The front frame portion 14 is laid over the piezoelectric element 7 and extends in the direction of arrangement of the long grooves 11, and the front frame portion 14 closes the opening ends of the long grooves 11 from the direction of the surface 2*a* of the base plate 2. In addition, the front frame portion 14 has an end face 14*a*. The end face 14*a* is positioned in the same plane as the end face 2*b* of the base plate 2 and the end face 7*b* of the piezoelectric element 7.

The top plate 4 is laid over the top plate frame 3, and is fixed to the top plate frame 3 by means of adhesion. The space, which is surrounded by the top plate 4, the top plate frame 3 and the surface 2*a* of the base plate 2, constitutes a common pressure chamber 15. The top plate 4 has a plurality of ink supply ports 16 which supply ink to the common pressure chamber 15.

According to the present embodiment, the extension portion 13 of the long groove 11, which reaches the surface 2*a* of the base plate 2, is exposed to the common pressure chamber 15. Thus, each long groove 11 communicates with the common pressure chamber 15 via the extension portion 13.

As shown in FIG. 1, FIG. 2 and FIG. 4, the nozzle plate 5 is adhered to the end face 2*b* of the base plate 2, the end face 7*b* of the piezoelectric element 7 and the end face 14*a* of the front frame portion 14 via an adhesive 18. The nozzle plate 5 is formed of a polyimide film with a thickness of, e.g. 50 μm, and closes the opening ends of the long grooves 11 from the direction of the end face 7*b* of the piezoelectric element 7.

The space, which is surrounded by the inner surfaces of the long grooves 11, the front frame portion 14 of the top plate frame 3 and the nozzle plate 5, constitutes a plurality of pressure chambers 19. The pressure chambers 19 are provided between neighboring ones of the partition walls 12 and are arranged in line at intervals in the longitudinal direction of the piezoelectric element 7. In addition, the pressure chambers 19 communicate with the common pressure chamber 15.

As shown in FIG. 2 to FIG. 4, the nozzle plate 5 includes a plurality of nozzles 21. The nozzles 21 are minute holes on the order of microns, which penetrate the nozzle plate 5 in its thickness direction. The nozzles 21 are formed by applying laser machining using, for example, an excimer laser device to the nozzle plate 5. The nozzles 21 are arranged in line at predetermined intervals so as to individually communicate with the pressure chambers 19, and are configured to face a recording medium on which printing is to be effected.

In the present embodiment, the focal point F of a laser beam, which is output from the excimer laser device, is set at a position with a displacement from the nozzle plate 5 to the outside. The laser beam continuously widens toward the pressure chamber 19, when the laser beam penetrates the nozzle plate 5.

Accordingly, the nozzle 21, which is formed by the laser beam, has a taper shape with a bore diameter gradually increasing toward the pressure chamber 19. The bore diameter of the nozzle 21 in the present embodiment is 50 μm at an upstream end thereof opening to the pressure chamber 19, and is 30 μm at a discharge end thereof toward the recording medium.

As shown in FIG. 4, a part of the adhesive 18, which is filled between the end face 7*b* of the piezoelectric element 7 and the nozzle plate 5, protrudes as an excess portion 20 into the pressure chamber 19. The excess portion 20 of the adhesive 18 is solidified in the state in which the excess portion 20 adheres to that surface of the nozzle plate 5, which faces the pressure chamber 19, and the excess portion 20 neighbors the opening end of the nozzle 21 within the pressure chamber 19.

Further, a cut portion 22 is formed at the excess portion 20 of the adhesive 18. The cut portion 22 is a part which is left after the laser beam for forming the nozzle 21 has passed through the excess portion 20, and the cut portion 22 is inclined so as to be continuous with the inner surface of the nozzle 21.

Specifically, as indicated by a two-dot-and-dash line in FIG. 4, in the case where an end portion 20*a* of the excess portion 20 protrudes into the opening end of the nozzle 21, which opens to the pressure chamber 19, the end portion 20*a* is removed by the laser beam which penetrates the nozzle plate 5. Thus, the cut portion 22 extends in the direction of radiation of the laser beam.

An electrode 24 is formed on the surface of the partition wall 12, which faces the pressure chamber 19, and the bottom of the pressure chamber 19. The electrode 24 is formed by plating so as to have a uniform thickness. The method of forming the electrode 24 is not limited to the plating, but it may be sputtering or evaporation deposition, for example.

Figure 13:
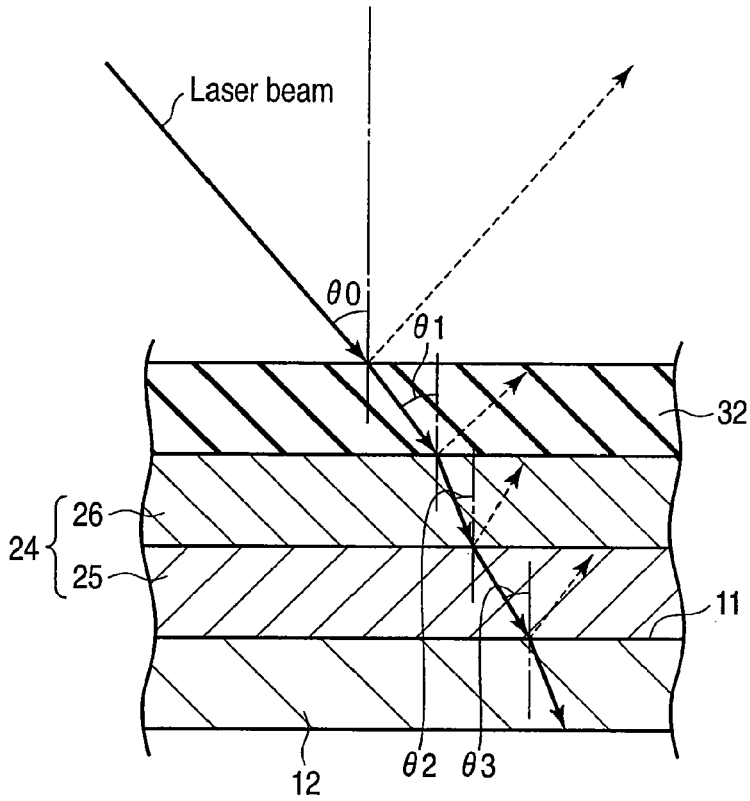
FIG. 13 is a cross-sectional view which schematically shows the state in which a laser beam is incident on the first protection film, the electrode and the piezoelectric element in the first embodiment.

As shown in FIG. 13, the electrode 24 in this embodiment has a two-layer structure comprising a nickel-plating layer 25 and a gold-plating layer 26. The nickel-plating layer 25 is laid over the inner surface of the long groove 11, and forms a predetermined electrode pattern. The gold-plating layer 26 is stacked on the nickel-plating layer 25, and covers the nickel-plating layer 25. The electrodes 24 are electrically isolated in association with the respective pressure chambers 19.

The respective electrodes 24 have conductor patterns 27 (only one conductor pattern 27 is shown in FIG. 2). The conductor patterns 27 are led to the surface 2*a* of the base plate 2 via the common pressure chamber 15. In addition, the conductor patterns 27 are led out of the top plate frame 3 and are electrically connected to a flexible printed wiring board 28. A driving circuit 29 which drives the ink jet head 1 is mounted on the flexible printed wiring board 28.

The driving circuit 29 supplies driving pulses to the electrodes 24 of the ink jet head 1. Then, a potential difference occurs between the neighboring electrodes 24 between which the pressure chamber 19 is interposed, and an electric field occurs in the partition walls 12 corresponding to the electrodes 24. As a result, the partition walls 12, which neighbor with the pressure chamber 19 being interposed, bend in such a direction as to increase the volume of the pressure chamber 19 by shear-mode deformation. Thereafter, if the polarities of the driving pulses, which are supplied to the electrodes 24, are reversed, the partition walls 12 restore to initial positions. With the partition walls 12 restoring to the initial positions, the ink, which is supplied from the common pressure chamber 15 to the pressure chambers 19, is pressurized. Part of the pressurized ink is discharged, in the form of ink drops, from the nozzle 21 to the recording medium.

As shown in FIG. 2 to FIG. 4, the electrode 24 is covered with a protection layer 31 having electrical insulation properties. The protection layer 31 has a two-layer structure comprising a first protection film 32 and a second protection film 33. The first protection film 32 is formed of an inorganic material with electrical insulation properties such as silicon dioxide ($SiO_2$). The first protection layer 32 is laid over the gold-plating layer 26 that is the surface layer of the electrode 24. Further, an end portion of the first protection film 32, which is adjacent to the nozzle plate 5, is covered with the excess portion 20 of the adhesive 18.

The second protection film 33 is formed of an organic material with electrical insulation properties, such as parylene (poly-para-xylylene). The second protection film 33 is stacked on the first protection film 32, covers the first protection film 32 and the excess portion 20 of adhesive 18, and is exposed to the inside of the pressure chamber 19.

As shown in FIG. 4, when the nozzle 21 is to be laser-machined, the laser beam penetrates the nozzle plate 5 and enters the pressure chamber 19. In particular, since the focal point F of the laser beam is positioned outside the nozzle plate 5, the laser beam gradually widens toward the pressure chamber 19.

The laser beam is incident at an acute angle on the second protection film 33 which is exposed to the pressure chamber 19. The second protection film 33 receives radiation of the laser beam in the vicinity of the nozzle 21. If the laser beam is radiated on the second protection film 33, the second protection film 33 is decomposed and evaporated in the region of radiation of the laser beam. As a result, a damage hole 35 forms at a position corresponding to that region of the second protection film 33, which is irradiated with the laser beam.

Thus, the first protection film 32 is exposed to the pressure chamber 19 via the damage hole 35. In other words, even if the second protection film 33 is partly lost, the electrode 24 is covered with the first protection film 32. Hence, for example, even in the case where ink having electrical conductivity is supplied in the pressure chamber 19, an electrical insulation state can be kept between the electrode 24 and the ink. Therefore, corrosion of the electrode 24 and electrolysis of ink can be prevented.

As shown in FIG. 4, an edge portion of the second protection film 33, which defines the damage hole 35, includes an inclined portion 35*a*. The inclined portion 35*a* is inclined along the direction of radiation of the laser beam, and is continuous with the cut portion 22 of the adhesive 18.

Since the first protection film 32 is formed of the inorganic material, it is said to be difficult to completely eliminate the occurrence of a pinhole. However, the first protection film 32 is covered with the second protection film 33, except for the location of the damage hole 35. Thus, even if a pinhole is present in the first protection film 32, the possibility is low that the electrical insulation of the electrode 24 is lost.

The inventor conducted a test, as will be described below, in order to confirm whether a pinhole is present in the second protection film 33 that is formed of the organic material.

In this test, three kinds of test pieces were prepared, wherein parylene films having thicknesses of 1 μm, 2 μm and 3 μm are laid over the surfaces of gold electrodes, respectively. After an excimer laser beam with an intensity of 10 mJ was radiated on the respective test pieces, the electrical insulation properties of the test pieces were examined.

As a result, it was found that electrical insulation was lost in the test piece in which the thickness of the parylene film was set at 1 μm, and in the test piece in which the thickness of the parylene film was set at 2 μm, and the presence of pinholes was made clear. On the other hand, as regards the test piece in which the thickness of the parylene film was set at 3 μm, it was found that the electrical insulation of the test piece was fully secured and there was no pinhole. In the examination of the electrical insulation, the presence/absence of electrical conduction was confirmed by a red reaction of phenollein liquid. The intensity of the excimer laser beam was set at 10 mJ in order to conduct this test under the same condition as the energy of a laser beam which is needed at the time of forming the nozzle 21 in the nozzle plate 5 using a polyimide film.

From the result of this test, the conclusion was reached that it is desirable to set the thickness of the second protection film 33 at, at least, 3 μm.

Next, referring to FIG. 5 to FIG. 13, a description is given of the procedure of manufacturing the ink jet head 1 having the above-described structure.

Figure 5:
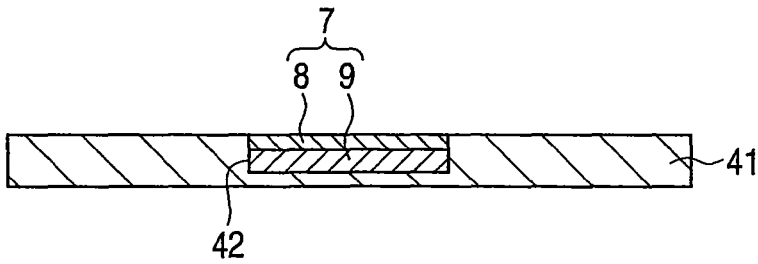
FIG. 5 is a cross-sectional view showing the state in which a piezoelectric element is embedded in a base plate structure body in the first embodiment.

To start with, two piezoelectric members 8 and 9 are mutually bonded to form a piezoelectric element 7 in which the polarization directions of the piezoelectric members 8 and 9 are opposite to each other. Further, as shown in FIG. 5, a base plate structure body 41 having double the size of the base plate 2 is prepared. As the material of the base plate structure body 41, use is made of PZT having a lower dielectric constant than the piezoelectric element 7. The base plate structure body 41 has a recess portion 42 at a central part of the surface thereof. The piezoelectric element 7 is embedded and adhered in the recess portion 42.

Figure 6:
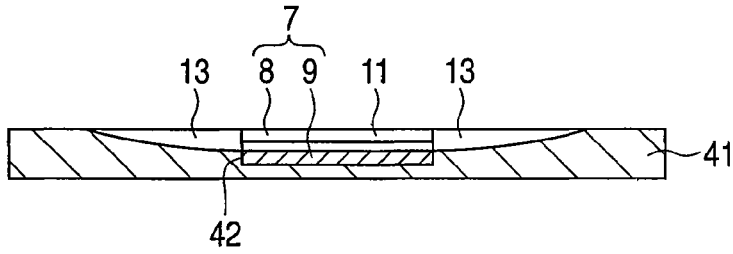
FIG. 6 is a cross-sectional view showing the state in which a plurality of long grooves are formed in the base plate structure body and the piezoelectric element in the first embodiment.

Thereafter, as shown in FIG. 6, a plurality of long grooves 11 (only one groove is shown) are formed in the piezoelectric element 7, which is embedded in the base plate structure body 41, by using a diamond blade, for example. The long grooves 11 extend in a transverse direction of the piezoelectric element 7, and are arranged at regular intervals in the longitudinal direction of the piezoelectric element 7.

When the long grooves 11 are formed in the piezoelectric element 7, the surface of the base plate structure body 41 is cut by a diamond blade in a groove shape. The cut parts are continuous with the long grooves 11 and function as extension portions 13 each having a depth gradually decreasing.

Subsequently, by applying electroless nickel plating to the inner surface of the long groove 11 including the extension portion 13 and the surface of the base plate structure body 41, a nickel-plating layer 25 having a predetermined pattern is formed. Subsequently, by applying gold plating to the nickel-plating layer 25, a gold-plating layer 26 is formed. As a result, a two-layered electrode 24 and a conductor pattern 27 are formed in each long groove 11. The conductor pattern 27 is led to an outer peripheral part of the surface of the base plate structure body 41. In FIG. 5 to FIG. 12, depiction of the electrode 24 and conductor pattern 27 is omitted.

Figure 7:
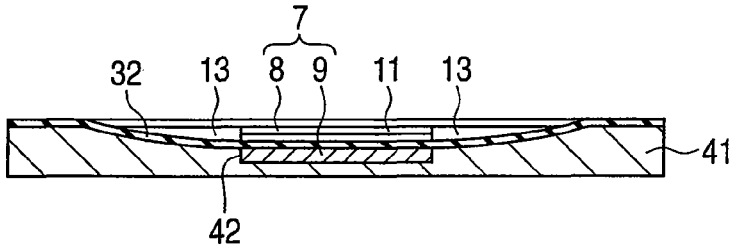
FIG. 7 is a cross-sectional view showing the state in which a first protection film is formed on the surface of the base plate structure body and on the inner surface of the long groove in the first embodiment.

Then, as shown in FIG. 7, a first protection film 32, which is formed of an inorganic material with electrical insulation properties, is formed on the inner surface of the long groove 11 in which the electrode 24 is formed, and on the surface of the base plate structure body 41. The first protection film 32 covers the electrode 24, the inner surface of the long groove 11 and the surface of the base plate structure body 41.

As the method of forming the first protection film 32, use can be made of, for example, CVD (chemical vapor deposition), ALD (atomic layer deposition), an evaporation deposition method, a coating method and a printing method. In other words, in a vacuum or atmospheric air, an inorganic material is subjected to a chemical reaction or is condensed on the gold-plating layer 26 that is the surface layer of the electrode 24. Thereby, the first protection film 32 is formed on the gold-plating layer 26.

When the first protection film 32 is to be formed, masking is applied to a part of the conductor pattern 27 that is led out to the surface of the base plate structure body 41. By this masking, the first protection film 32 is prevented from being formed on that part of the conductor pattern 27, to which the flexible printed circuit board 28 is to be connected.

As the inorganic material, of which the first protection layer 32 is formed, use may be made of, for instance, $Al_2O_3$, $SiO_2$, ZnO, MgO, $ZrO_2$, $Ta_2O_5$, $Cr_2O_3$, $TiO_2$, $Y_2O_3$, YBCO, mullite ($Al_2O_3.SiO_2$), $SrTiO_3$, $Si_3N_4$, ZrN, or AlN, these materials having refractive indices in the range of 1.1 to 2.0.

Figure 8:
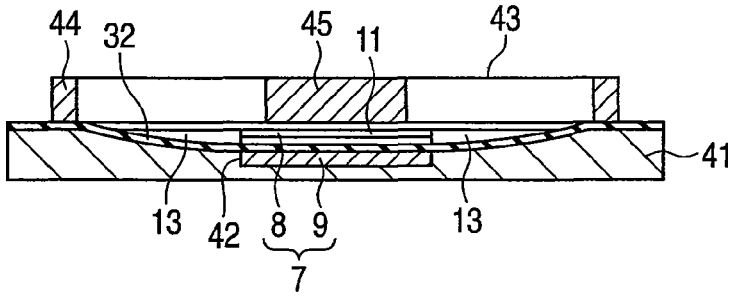
FIG. 8 is a cross-sectional view showing the state in which a top plate frame structure body is adhered to the base plate structure body after the first protection film is formed on the surface of the base plate structure body in the first embodiment.

As shown in FIG. 8, after the first protection film 32 is formed, the top plate frame structure body 43 is fixed to the surface of the base plate structure body 41 by means of, e.g. adhesion. The top plate frame structure body 43 includes an outer frame portion 44 and a central portion 45. The outer frame portion 44 is laid over an outer peripheral portion of the surface of the base plate structure body 41. The central portion 45 is surrounded by the outer frame portion 44, and is stacked on the piezoelectric element 7 in which the long grooves 11 are formed. Thus, the central portion 45 of the top plate frame structure body 43 closes the opening ends of the long grooves 11 from the direction of the surface of the base plate structure body 41.

Figure 9:
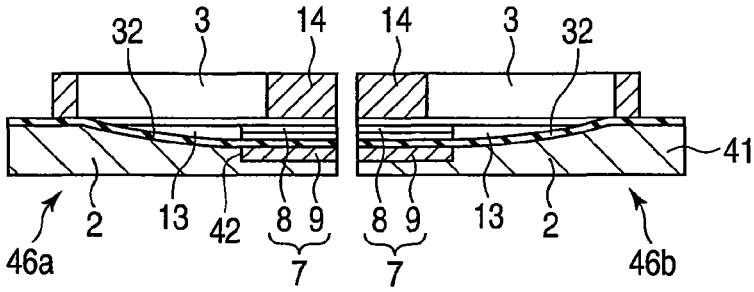
FIG. 9 is a cross-sectional view showing the state in which the base plate structure body, to which the top plate frame structure body is adhered, is divided into two head blocks by a cutting process in the first embodiment.

Subsequently, as shown in FIG. 9, a cutting process using a diamond blade, for example, is performed on the base plate structure body 41 to which the top plate frame structure body 43 is adhered, thereby dividing the base plate structure body 41, together with the top plate frame structure body 43, into two parts. By this division, a pair of head blocks 46*a* and 46*b*, each comprising the base plate 2 and top plate frame 3 as one body, are formed. In each of the head blocks 46*a* and 46*b*, the end face 2*b* of the base plate 2, the end face 7*b* of the piezoelectric element 7 and the end face 14*a* of the front frame portion 14 of the top plate frame 3 are flush and continuous with each other.

Figure 10:
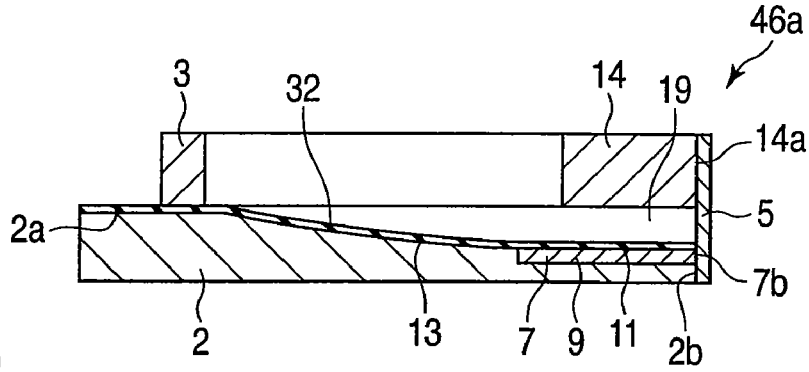
FIG. 10 is a cross-sectional view showing the state in which a nozzle plate, in which nozzles are yet to be formed, is attached to the end face of the head block in the first embodiment.

Then, as shown in FIG. 10 which representatively shows one of the head blocks, 46*a*, the nozzle plate 5, in which nozzles are yet to be formed, is adhered by the adhesive 18 in a manner to span the end face 2*b* of the base plate 2, the end face 7*b* of the piezoelectric element 7 and the end face 14*a* of the front frame portion 14 of the top plate frame 3. As a result, a plurality of pressure chambers 19 are formed between the nozzle plate 5, the long grooves 11 of the base plate 2 and the front frame portion 14 of the top plate frame 3.

As shown in FIG. 4, the excess portion 20 of the adhesive 18 protrudes into the pressure chamber 19. The protruding excess portion 20 of the adhesive 18 is solidified as a thin film on that surface of the nozzle plate 5, which faces the pressure chamber 19.

Figure 11:
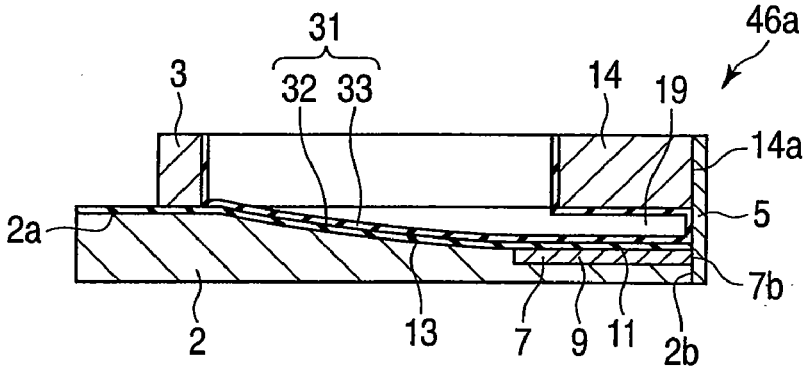
FIG. 11 is a cross-sectional view showing the state in which a second protection film is stacked on the first protection film after the nozzle plate is adhered to the head block in the first embodiment.

Subsequently, as shown in FIG. 11, a second protection film 33, which is formed of an organic material with electrical insulation properties, is formed on the inner surface of the pressure chamber 19 and the inner surface of the top plate frame 3. The second protection film 33 is stacked on the first protection film 32 and covers the first protection film 32. As the material of the second protection film 33, use may be made of, for instance, parylene (poly-para-xylylene) or polyimide.

In the present embodiment, after the nozzle plate 5 is adhered in a manner to span the end faces 2*b*, 7*b* and 14*a* which are located at the cut end of the head block 46*a*, 46*b*, the second protection film 33 is formed on the inner surface of the pressure chamber 19. When the base plate structure body 41 is divided into the two head blocks 46*a*, 46*b*, as shown in FIG. 9, it may be possible that the end face 7*b* of the piezoelectric element 7, which is located at the cut end of the head block, becomes a rough surface on which a trace of cutting is left.

In the present embodiment, after the nozzle plate 5 is attached to the end face 7*b* of the piezoelectric element 7, the second protection film 33 is formed on the inner surface of the pressure chamber 19. Thus, as shown in FIG. 4, the second protection film 33 is formed on the inside of the pressure chamber 19 so as to cover the excess portion 20 of the adhesive 18 and to fully reach a boundary area between the long groove 11 and the nozzle plate 5.

Figure 12:
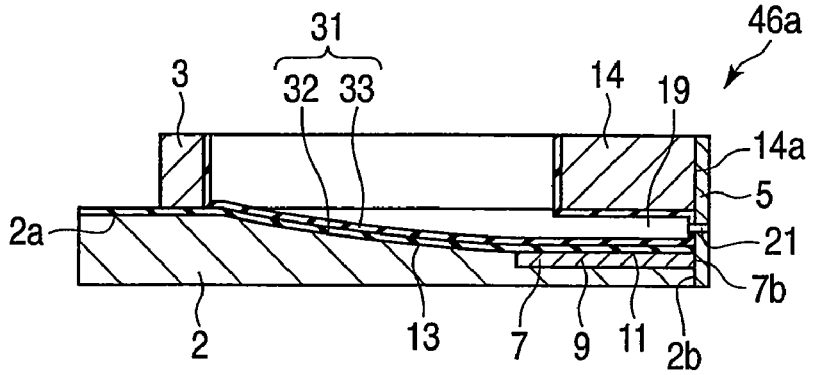
FIG. 12 is a cross sectional view showing the state in which nozzles are formed by using a laser beam in the nozzle plate which is adhered to the head block in the first embodiment.

Thereafter, as shown in FIG. 4 and FIG. 12, a plurality of nozzles 21 are formed by applying laser machining using, for example, an excimer laser device, to the nozzle plate 5. Specifically, the nozzles 21 are formed by radiating a laser beam to the nozzle plate 5 from the side opposite to the pressure chamber 19 and chemically decomposing the nozzle plate 5 which is formed of a polyimide film.

At this time, since the focal point F of the laser beam is positioned outside the nozzle plate 5, the laser beam gradually widens toward the pressure chamber 19. Thus, the nozzle 21 is formed in a taper shape with a bore diameter continuously increasing toward the pressure chamber 19.

As shown in FIG. 4, after penetrating the nozzle plate 5 in its thickness direction, the laser beam enters the pressure chamber 19. The second protection film 33, which is exposed to the pressure chamber 19, receives radiation of the laser beam in the vicinity of the nozzle 21. If the laser beam is radiated on the second protection film 33, that region of the second protection film 33, which has been irradiated with the laser beam, is decomposed and evaporated, and a damage hole 35 forms in the second protection film 33.

Further, in the case where the end portion 20*a* of the excess portion 20 of the adhesive 18 protrudes into that region in the pressure chamber 19, where the nozzle 21 is to be formed, the end portion 20*a* of the excess portion 20 is removed by the laser beam which is made incident in the pressure chamber 19. As a result, a cut portion 22 along the direction of radiation of the laser beam is formed at the excess portion 20 of the adhesive 18.

Accordingly, in the ink jet head 1 which is configured such that the nozzles 21 are formed in the nozzle plate 5 by using the laser beam after the nozzle plate 5 is adhered to the piezoelectric element 7, the cut portion 22 along the direction of incidence of the laser beam is formed at the excess portion 20 of the adhesive 18. In addition, the damage hole 35 due to the radiation of the laser beam is formed in the second protection film 33 which faces the pressure chamber 19.

After the nozzles 21 are formed in the nozzle plate 5, the top plate 4 is adhered to the top plate frame 3. By this adhesion, the common pressure chamber 15, which communicates with the pressure chambers 19, is formed, and the series of fabrication steps of the ink jet head 1 is completed.

In the case of manufacturing the ink jet head 1 by the above-described procedure, the laser beam is radiated on the first protection film 32 via the damage hole 35 that is formed in the second protection film 33. Consequently, that part of the first protection film 32, which corresponds to the damage hole 35, may possibly evaporate due to the reception of the laser beam, and the piezoelectric characteristics of the PZT, of which the partition walls 12 are formed, may possibly degrade due to the laser beam radiated on the first protection film 32.

In order to prevent the evaporation of the first protection film 32 and the degradation of the piezoelectric characteristics of the PZT of which the partition walls 12 are formed, it is necessary to reflect the laser beam which is radiated on the first protection film 32 through the damage hole 35.

The reflectance of the first protection film 32 varies depending on the thickness and refractive index of the first protection film 32. The inventor mathematically analyzed the reflectance of the laser beam which is incident on the first protection film 32, by using the Snell's law and Fresnel coefficient, and found the conditions of the thickness and refractive index of the first protection film 32, which are necessary in order to prevent the degradation of the piezoelectric characteristics of the PZT of which the partition walls 12 are formed.

FIG. 13 schematically shows the state in which a laser beam is incident on the electrode 24 and first protection film 32, which are stacked on the PZT-made partition wall 12. In FIG. 13, θ0 is an angle at which the laser beam, which has penetrated the nozzle plate 5, is incident on the first protection film 32; θ1 is an angle at which the laser beam, which is refracted by interference with the first protection film 32, is incident on the gold-plating layer 26 of the electrode 24 from the first protection film 32; θ2 is an angle at which the laser beam, which is refracted by interference with the gold-plating layer 26, is incident on the nickel-plating layer 25 from the gold-plating layer 26; and θ3 is an angle at which the laser beam, which is refracted by interference with the nickel-plating layer 25, is incident on the partition wall 12 from the nickel-plating layer 25. In addition, broken-line arrows in FIG. 13 indicate laser beams which are reflected by the first protection film 32, gold-plating layer 26, nickel-plating layer 25 and partition wall 12.

In general, there are four methods of calculating a reflectance in the case where light is incident on a plurality of films (layers) having specific refractive indices. These calculation methods are classified into a method in the case where no light absorption occurs in each layer and light is incident perpendicular to interfaces; a method in the case where no light absorption occurs in each layer and light is incident at an acute angle to interfaces; light absorption occurs in each layer and light is incident perpendicular to interfaces; and a method in the case where light absorption occurs in each layer and light is incident at an acute angle to interfaces.

In the present embodiment, the laser beam, which has penetrated the nozzle plate 5, is incident on the first protection film 32 through the damage hole 35 at an angle of inclination of θ0. Further, since the nickel-plating layer 25 and gold-plating layer 26, which constitute the electrode 24, are metallic layers which absorb light, light absorption occurs in each of the first protection film 32, nickel-plating layer 25 and gold-plating layer 26. Thus, the reflectance of light can be found by using the calculation method in the case where light is incident at an acute angle to interfaces.

To begin with, the method of calculating a reflectance is explained.

The Fresnel coefficient of reflection of the nickel-plating layer 25, which is in contact with the PZT-made partition wall 12, can be expressed by the following equation:

$$\rho_3 = \frac{a(3)_3 - ib(3)_1}{a(3)_2 - ib(3)_2} = \frac{A_3 - iB_3}{C_3 - iD_3}$$

Then, the Fresnel coefficient $\sigma_2'$ of imaginary planes by the upper surface and lower surface of the nickel-plating layer 25, can be expressed by the following equation:

$$\begin{aligned}\rho_2' &= \frac{\rho_2 + \rho_3 e^{-i2\Delta_3}}{1 + \rho_2\rho_3 e^{-i2\Delta_3}} \\ &= \frac{\dfrac{a(2)_1 - ib(2)_1}{a(2)_2 - ib(2)_2} + \dfrac{A_3 - iB_3}{C_3 - iD_3}(\cos 2\delta_3 - i\sin 2\delta_3)e^{-2\gamma_3}}{1 + \dfrac{a(2)_1 - ib(2)_1}{a(2)_2 - ib(2)_2} \times \dfrac{A_3 - iB_3}{C_3 - iD_3}(\cos 2\delta_3 - i\sin 2\delta_3)e^{-2\gamma_3}} \\ &= \frac{A_2 - iB_2}{C_2 - iD_2}\end{aligned}$$

If the calculation of the Fresnel coefficient of reflection is successively repeated from the nickel-plating layer 25 to the first protection film 32 in the same manner, the final Fresnel coefficient can be expressed by the following equation:

$$\rho_0' = \frac{A_0 - iB_0}{C_0 - iD_0} = \frac{A_0C_0 + B_0D_0 + i(A_0D_0 - B_0C_0)}{C_0^2 + D_0^2}$$

Thus, the reflectance R is as follows:

$$R = |\rho_0'|^2 = \frac{A_0^2 + B_0^2}{C_0^2 + D_0^2}$$

where $$x_j = (u_j^2 + v_j^2)^{1/4}\cos(\xi/2)$$

$$y_j = (u_j^2 + v_j^2)^{1/4}\sin(\xi/2)$$

$$u_j = n_j^2 - k_j^2 - n_0^2\sin^2\theta_0$$

$$v_j = 2n_jk_j$$

$$N_j = n_j - ik_j$$

$$\delta_j = (2\pi/\lambda)x_jd_j$$

$$\gamma_j = (2\pi/\lambda)y_jd_j$$

$$A_3 = x_3 - x_4$$

$$B_3 = y_3 - y_4$$

$$C_3 = x_3 + x_4$$

$$D_3 = y_3 + y_4$$

-continued $$A_{L-1} = a(L-1)_1C_L - b(L-1)_1D_L + \left[\begin{Bmatrix} a(L-1)_2A_L - \\ b(L-1)_2B_L \end{Bmatrix}\cos 2\delta_L - \begin{Bmatrix} a(L-1)_2B_L + \\ b(L-1)_2A_L \end{Bmatrix}\sin 2\delta_L\right]e^{-2\gamma_L}$$

$$B_{L-1} = a(L-1)_1D_L + b(L-1)_1C_L + \left[\begin{Bmatrix} a(L-1)_2B_L + \\ b(L-1)_2A_L \end{Bmatrix}\cos 2\delta_L + \begin{Bmatrix} a(L-1)_2A_L - \\ b(L-1)_2B_L \end{Bmatrix}\sin 2\delta_L\right]e^{-2\gamma_L}$$

$$C_{L-1} = a(L-1)_2C_L - b(L-1)_2D_L + \left[\begin{Bmatrix} a(L-1)_1A_L - \\ b(L-1)_1B_L \end{Bmatrix}\cos 2\delta_L - \begin{Bmatrix} a(L-1)_1B_L + \\ b(L-1)_1A_L \end{Bmatrix}\sin 2\delta_L\right]e^{-2\gamma_L}$$

$$D_{L-1} = a(L-1)_2D_L + b(L-1)_2C_L + \left[\begin{Bmatrix} a(L-1)_1B_L + \\ b(L-1)_1A_L \end{Bmatrix}\cos 2\delta_L + \begin{Bmatrix} a(L-1)_1A_L - \\ b(L-1)_1B_L \end{Bmatrix}\sin 2\delta_L\right]e^{-2\gamma_L}$$

$$(j = 0, 1, 2, 3, 4,\ L = 0, 1, 2)$$

A concrete example of the calculation of the reflectance of the laser beam, which is incident on the first protection film 32, is as follows.

The refractive index of the PZT-made partition wall 12 was set at $N_4$=1.8 ($n_4$=1.8, $K_4$=0), the refractive index of the nickel-plating layer 25 was set at $N_3$=1.4−i2.1 ($n_3$=1.4, $K_3$=2.1), the refractive index of the gold-plating layer 26 was set at $N_2$=1.4−i2.1 ($n_2$=1.4, $K_2$=2.1), the refractive index of atmospheric air was set at $N_0$=1 ($n_0$=1, $K_0$=0), the thickness $d_3$ of the nickel-plating layer 25 was set at 2 μm, the thickness $d_2$ of the gold-plating layer 26 was set at 300 μm, the angle θ0 at which the laser beam is incident on the first protection film 32 from the atmospheric air was set at 15°, and the wavelength of the laser beam was set at 248 nm.

Under this condition, the refractive index $N_1$ and thickness $d_1$ of the first protection film 32 were varied, and the energy reflectance of the laser beam, which has been radiated on the partition wall 12, was calculated.

Figure 14:
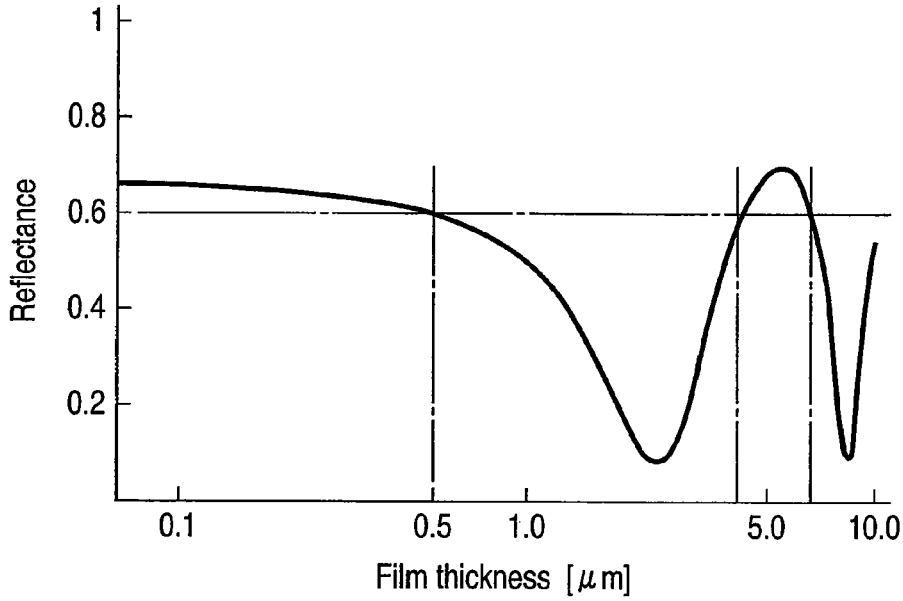
FIG. 14 is a characteristic graph showing the relationship between the energy reflectance and the film thickness of the first protection film at a time when the refractive index of the first protection film, on which a laser beam is radiated, is set at 1.5 in the first embodiment.

FIG. 14 shows the relationship between the energy reflectance of the laser beam, which has been radiated on the partition wall 12, and the thickness of the first protection film 32, at a time when the refractive index of the first protection film 32 was set at 1.5. Based on the calculation from the output of the laser beam, if the energy reflectance of the laser beam is 60% or more, the possibility is low that the piezoelectric characteristics of the partition wall 12 are degraded and also the possibility is low that the first protection film 32 is evaporated by the energy of the laser beam.

As shown in FIG. 14, the thickness of the first protection film 32, at which the energy reflectance of the laser beam is 60% or more, is in the range of 0.1 μm to 0.5 μm and in the range of 4 μm to 6 μm. However, if the thickness of the first protection film 32 exceeds 3 μm, the internal stress of the first protection film 32 increases, the base plate 2 warps, and the top plate frame 3 cannot be attached on the base plate 2. In worst cases, a crack occurs in the first protection film 32, and the first protection film 32 may be damaged.

Figure 15:
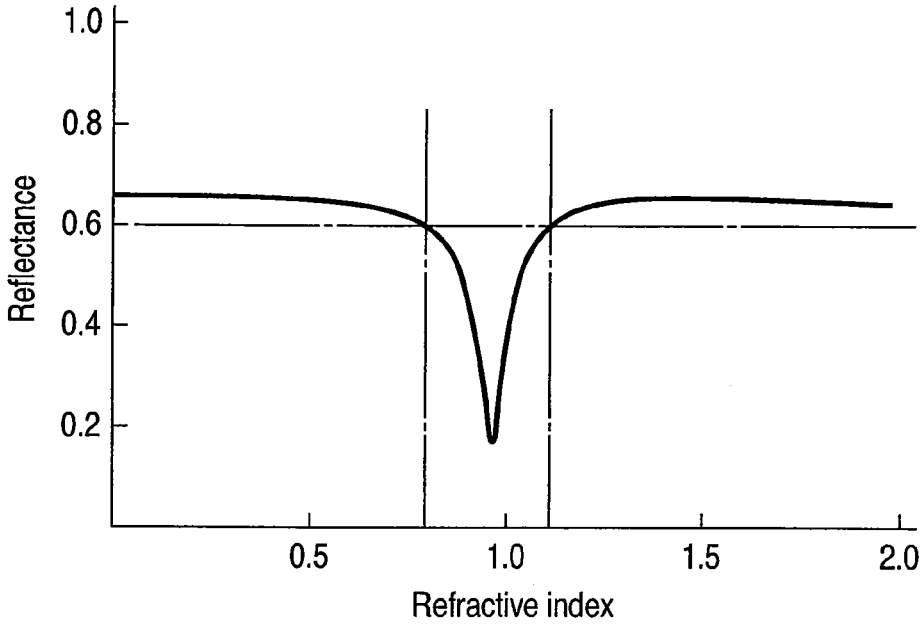
FIG. 15 is a characteristic graph showing the relationship between the energy reflectance and the refractive index of the first protection film at a time when the film thickness of the first protection film, on which a laser beam is radiated, is set at 0.1 μm in the first embodiment.

FIG. 15 shows the relationship between the energy reflectance of the laser beam, which has been radiated on the partition wall 12, and the refractive index of the first protection film 32, at a time when the thickness of the first protection film 32 was set at 0.1 μm. As is clear from FIG. 15, the refractive index of the first protection film 32, at which the energy reflectance of the laser beam is 60% or more, is in the range of 0.1 to 0.8 and in the range of 1.1 to 2.0.

However, the material with a refractive index of 1 or less is a metal, which fails to have electrical insulation properties that are the indispensable requirement of the first protection film 32. In addition, general electrically insulative materials have refractive indices in the range of 1.1 to 1.3. Thus, it is desirable that the refractive index of the first protection film 32 be in the range of 1.1 to 2.0.

The inventor conducted the following test on the basis of the result that was obtained from FIG. 14 and FIG. 15.

In this test, three kinds of test pieces were prepared, wherein silicon dioxide ($SiO_2$) having a refractive index of 1.5 was stacked, with thicknesses of 0.1 μm, 0.2 μm and 0.4 μm, over gold-plating layers 26 of electrodes 24. After a laser beam was radiated on the respective test pieces, the composition analysis of the partition wall 12 was conducted with respect to each of the test pieces.

As a result, it was confirmed that silicon dioxide is present on the gold-plating layers 26 in all the test pieces. Furthermore, as regards the degree of degradation of piezoelectric characteristics of the partition wall 12 of each test piece, it was confirmed that this degree is within such a range that no problem arises in the discharge of ink.

From the above, if the thickness of the first protection film 32 is in the range of 0.1 μm to 0.5 μm and the refractive index of the first protection film 32 is in the range of 1.1 to 2.0, it is possible to prevent the evaporation of the first protection film 32 and the degradation of piezoelectric characteristics of the partition wall 12 due to the radiation of the laser beam, even if the damage hole 35 due to the radiation of the laser beam forms in the second protection film 33.

Thus, the electrical insulation between the electrode 24 and ink can be maintained, and the corrosion of the electrode 24 and electrolysis of ink can be prevented. Therefore, the durability of the ink jet head 1 can be enhanced while a good printing quality is maintained.

The invention is not limited to the first embodiment, and various modifications can be made without departing from the spirit of the invention.

FIG. 16 to FIG. 20 show a second embodiment of the invention. The second embodiment differs from the first embodiment with respect to the process of forming the protection layer 31. The second embodiment is the same as the first embodiment with respect to the basic structure of the ink jet head 1 and the procedure up to the formation of the protection layer 31. Thus, in the second embodiment, the same structural parts as those of the first embodiment are denoted by like reference numerals, and a description thereof is omitted here.

Figure 16:
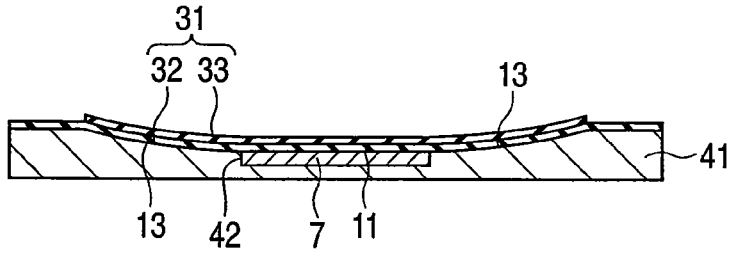
FIG. 16 is a cross-sectional view showing the state in which a first protection film is formed on the surface of the base plate structure body and the inner surface of the long groove, and a second protection film is stacked on the first protection film, in a second embodiment.

As shown in FIG. 16, a first protection film 32, which is formed of an inorganic material with electrical insulation properties, is formed on the inner surface of the long groove 11 in which the electrode is formed, and on the surface of the base plate structure body 41. Silicon dioxide ($SiO_2$) having a refractive index of 1.5 was used as the material of the first protection film 32, and the thickness of the first protection film 32 was set in the range of 0.1 μm to 0.5 μm.

Subsequently, a second protection film 33 is stacked on the first protection film 32, and covers the first protection film 32. Parylene (poly-para-xylylene) that is an organic material was used as the material of the second protection film 33, and the thickness of the second protection film 32 was set at, at least, 3 μm.

Figure 17:
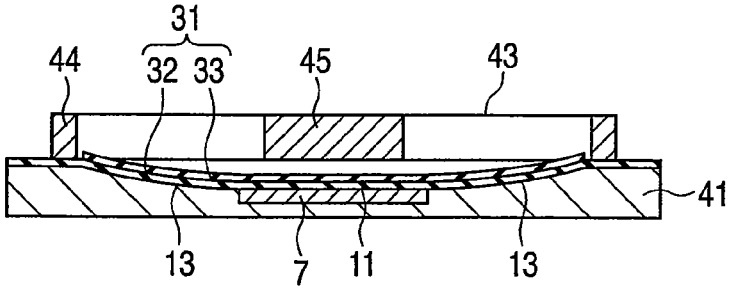
FIG. 17 is a cross-sectional view showing the state in which a top plate structure body is adhered to the base plate structure body after the first and second protection films are formed on the surface of the base plate structure body in the second embodiment.

Thereafter, as shown in FIG. 17, the top plate frame structure body 43 is fixed to the surface of the base plate structure body 41 by means of, e.g. adhesion. The central portion 45 of the top plate frame structure body 43 is stacked on the piezoelectric element 7 in which the long groove 11 is formed. Thus, the central portion 45 of the top plate frame structure body 43 closes the opening end of the long groove 11 from the direction of the surface of the base plate structure body 41.

Figure 18:
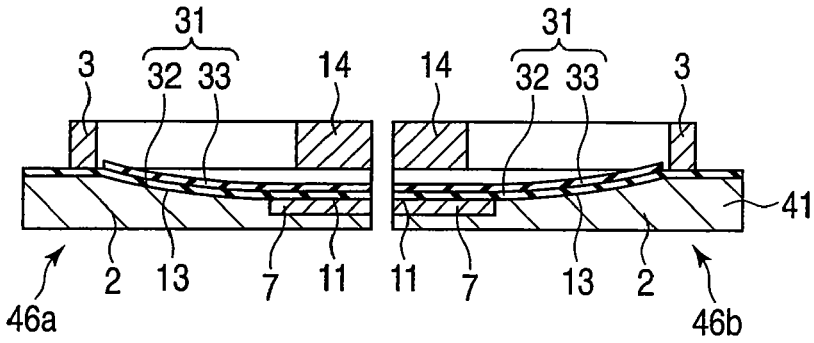
FIG. 18 is a cross-sectional view showing the state in which the base plate structure body, to which the top plate structure body is adhered, is divided into two head blocks by a cutting process, in the second embodiment.

Subsequently, as shown in FIG. 18, a cutting process using a diamond blade, for example, is performed on the base plate structure body 41 to which the top plate frame structure body 43 is adhered, thereby dividing the base plate structure body 41, together with the top plate frame structure body 43, into two parts. Thus, two head blocks 46*a* and 46*b* are formed.

Figure 19:
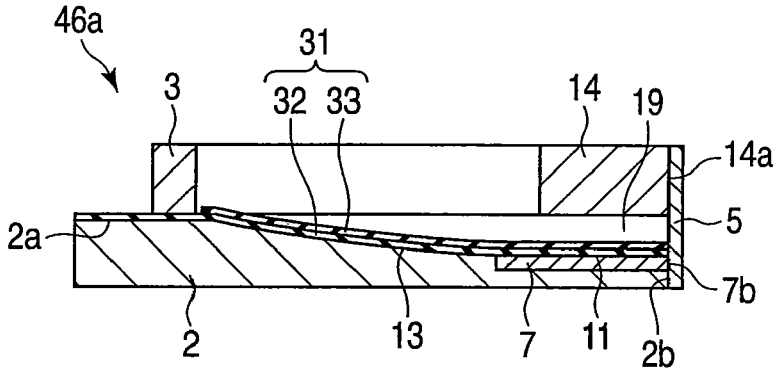
FIG. 19 is a cross-sectional view showing the state in which the nozzle plate, in which nozzles are yet to be formed, is adhered to the end face of the head block in the second embodiment.

Then, as shown in FIG. 19 which representatively shows one of the head blocks, 46*a*, the nozzle plate 5, in which nozzles are yet to be formed, is adhered by the adhesive 18 in a manner to span the end face 2*b* of the base plate 2, the end face 7*b* of the piezoelectric element 7 and the end face 14*a* of the front frame portion 14 of the top plate frame 3.

Figure 20:
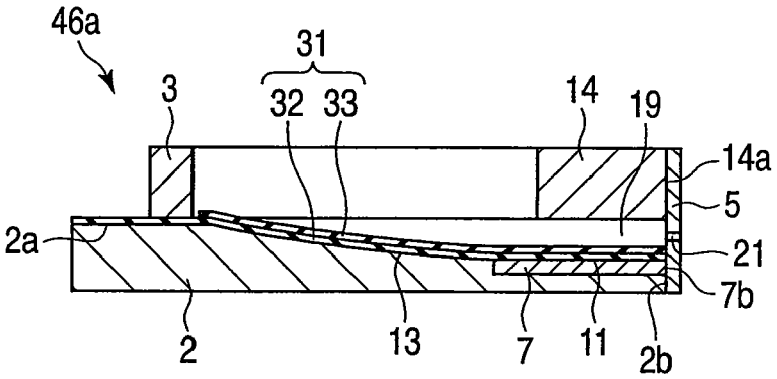
FIG. 20 is a cross-sectional view showing the state in which nozzles are formed, with use of a laser beam, in the nozzle plate which is adhered to the head block in the second embodiment.

At last, as shown in FIG. 20, a plurality of nozzles 21 are formed by applying laser machining using, for example, an excimer laser device, to the nozzle plate 5. Specifically, the nozzles 21 are formed by radiating a laser beam to the nozzle plate 5 from the side opposite to the pressure chamber 19 and chemically decomposing the nozzle plate 5.

In the second embodiment, after the electrode is covered with the protection layer 31, the nozzle plate 5 is adhered to the piezoelectric element 7. Then, the nozzles 21 are formed by radiating the laser beam on the nozzle plate 5.

Consequently, like the first embodiment, the laser beam, which has penetrated the nozzle plate 5, is inevitably radiated on the second protection film 32 in the vicinity of the nozzle 21, and a damage hole due to the radiation of the laser beam forms in the second protection film 32.

However, by setting the thickness of the first protection film 32 in the range of 0.1 μm to 0.5 μm and the refractive index of the first protection film 32 in the range of 1.1 to 2.0, it is possible to prevent the evaporation of the first protection film 32 due to the radiation of the laser beam, even if the damage hole 35 forms in the second protection film 33.

Therefore, like the first embodiment, the electrical insulation between the electrode and ink can be maintained, and the corrosion of the electrode and electrolysis of ink can be avoided. Thus, both the maintenance of the printing quality and the durability of the ink jet head can be achieved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet head comprising:

a piezoelectric element including a plurality of partition walls arranged at intervals, and a plurality of pressure chambers which are provided between neighboring ones of the partition walls and to which ink is supplied;

a nozzle plate including a plurality of nozzles which discharge the ink, the nozzles being formed by radiating a laser beam on the nozzle plate;

an adhesive which adheres the nozzle plate to the partition walls of the piezoelectric element such that the nozzles communicate with the pressure chambers;

an electrode provided on a surface of the partition wall facing the pressure chamber, the electrode being configured to deform, when supplied with a driving pulse, the partition walls, thereby pressurizing the ink that is supplied to the pressure chamber and discharging the ink from the nozzle;

a first protection film which covers the electrode and is formed of an inorganic material having electrical insulation properties; and a second protection film which is stacked on the first protection film, is exposed to the pressure chamber, and is formed of an organic material having electrical insulation properties, wherein the adhesive includes an excess portion which protrudes into the pressure chamber from between the nozzle plate and the partition wall, and a cut portion which is provided at the excess portion along a direction of radiation of the laser beam, and the second protection film includes a damage hole at an area on which the laser beam is made incident, the second protection film being removed from the damage hole, the first protection film is exposed to an inside of the pressure chamber at a position corresponding to the damage hole, at least a part of the first protection film, which corresponds to the damage hole, has a film thickness of 0.1 μm to 0.5 μm, and the first protection film has a refractive index of 1.1 to 2.0.

2. The ink jet head of claim 1, wherein the nozzle has a taper shape with a bore diameter gradually increasing toward the pressure chamber.

3. The ink jet head of claim 1, wherein the second protection film covers the excess portion of the adhesive within the pressure chamber.

4. The ink jet head of claim 1, wherein the electrode has a two-layer structure including a nickel-plating layer and a gold-plating layer which is stacked on the nickel-plating layer, the first protection film being laid over the gold-plating layer.

5. The ink jet head of claim 1, wherein the second protection film has a thickness of 3 μm.

6. The ink jet head of claim 1, wherein the ink has electrical conductivity.

7. The ink jet head of claim 2, wherein the cut portion of the adhesive is inclined in a manner to be continuous with an inner surface of the nozzle.

8. The ink jet head of claim 3, wherein the excess portion of the adhesive covers the first protection film.

9. The ink jet head of claim 7, wherein an edge portion of the second protection film, which defines the damage hole, includes an inclined portion which is inclined along a direction of radiation of the laser beam.

10. The ink jet head of claim 7, wherein the excess portion of the adhesive is solidified in a state in which the excess portion adheres to that surface of the nozzle plate, which faces the pressure chamber, and the excess portion neighbors an opening end of the nozzle within the pressure chamber.

11. The ink jet head of claim 9, wherein the inclined portion is continuous with the cut portion within the pressure chamber.

* * * * *